US007617867B2

(12) United States Patent
Lynde et al.

(10) Patent No.: US 7,617,867 B2
(45) Date of Patent: Nov. 17, 2009

(54) OVERSHOT TOOL

(75) Inventors: Gerald D. Lynde, Houston, TX (US); MalColm Derek Pitman, Grampian (GB)

(73) Assignee: Baker Hughes Incorporated, Houston, TX (US)

( * ) Notice: Subject to any disclaimer, the term of this patent is extended or adjusted under 35 U.S.C. 154(b) by 128 days.

(21) Appl. No.: 11/713,925

(22) Filed: Mar. 5, 2007

(65) Prior Publication Data

US 2008/0217014 A1 Sep. 11, 2008

(51) Int. Cl.
*E21B 31/18* (2006.01)

(52) U.S. Cl. ..... 166/98; 166/301; 294/86.26; 294/86.22; 294/86.31

(58) Field of Classification Search ..... 166/98, 166/301; 294/86.26, 86.33, 86.31, 86.22, 294/86.32, 86.17

See application file for complete search history.

(56) References Cited

U.S. PATENT DOCUMENTS

| | | | | |
|---|---|---|---|---|
| 2,687,323 | A * | 8/1954 | Stohn | 294/86.21 |
| 2,814,523 | A * | 11/1957 | Stolm | 294/86.21 |
| 3,667,547 | A * | 6/1972 | Ahlstone | 166/286 |
| 4,291,768 | A * | 9/1981 | Diehl | 166/378 |
| 5,829,524 | A | 11/1998 | Flanders et al. | 166/277 |
| 6,896,049 | B2 | 5/2005 | Moyes | |
| 2005/0072579 | A1 * | 4/2005 | Gambier | 166/387 |

OTHER PUBLICATIONS

Zeroth Technology Limited Homepage, www.zertech.com.

* cited by examiner

*Primary Examiner*—Giovanna C Wright
(74) *Attorney, Agent, or Firm*—Cantor Colburn LLP

(57) ABSTRACT

An overshot tool includes a grapple, a torque sub rotationally fixed to the grapple and a deformable member in operable communication with the torque sub. The torque sub is responsive to torsional movement thereof. A method for retrieving a fish with the tool is also included.

19 Claims, 1 Drawing Sheet

OVERSHOT TOOL

BACKGROUND

When tools get stuck downhole or become unserviceable for other reasons, they may also not be easily removable simply by pulling them out of the hole with the string above but may require the use of a fishing device such as an overshot tool. As one of ordinary skill in the art will recognize, an overshot tool generally extends over an outside diameter of a stuck tool or stub, grabs onto that tool or stub and allows an operator to pull the tool or stub to surface with the overshot tool. Generally such overshot tools further include seals to maintain pressure integrity.

Overshot tools have long been a valuable part of the fishing arsenal and have worked well for their intended purpose. Improvements, however, are always welcomed by the art.

SUMMARY

An overshot tool includes a grapple, a torque sub rotationally fixed to the grapple and a deformable member in operable communication with the torque sub. The torque sub is responsive to torsional movement thereof.

A method for retrieving a fish includes overshooting the fish with an overshot tool including a grapple, a torque sub rotationally fixed to the grapple, a top sub axial length adjustably attached to the torque sub, and a deformable member in operable communication with the torque sub. The method further includes actuating the grapple to contact the fish and adjusting an axial length of the top sub and torque sub to deform the deformable member.

BRIEF DESCRIPTION OF THE DRAWINGS

Referring now to the drawings wherein like elements are numbered alike in the several Figures.

DETAILED DESCRIPTION

Figure 1:
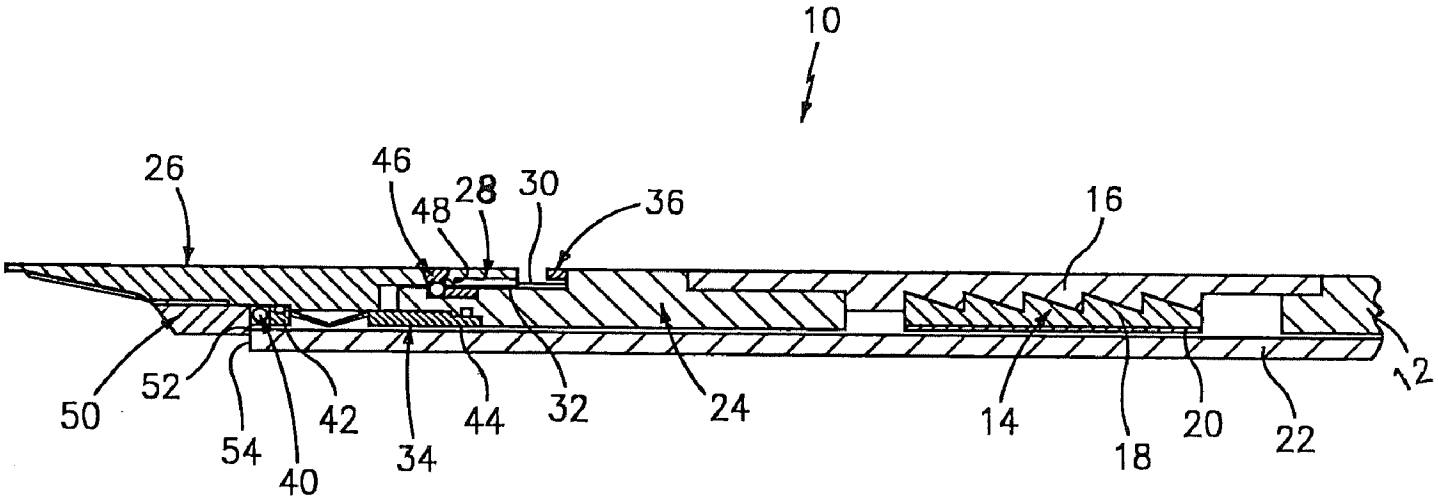
FIG. 1 is a schematic quarter section view of an embodiment of an overshot tool in a run in position.

In order to enhance understanding of the invention, Applicants have elected to describe first the components of the tool followed by a discussion of its operation. Referring to FIG. 1, each component of the device will be introduced. This is followed by reference to FIGS. 1 and 2 together, wherein operation of the device is discussed.

Overshot tool 10 comprises a bottom sub 12 attached at an uphole end thereof to a grapple 14 comprising a grapple housing 16 and grapple extension 18 (one or more individual extension pieces arranged annularly around the tool). The grapple further includes a contact layer 20 to interface between grapple extension(s) 18 and a stub 22 of a device or casing being overshot. At an uphole end of grapple 14, a torque sub 24 is positioned and fixedly connected to the grapple 14. The Torque sub 24 is telescopically operably connected to a top sub 26 meaning that the total length of the torque sub and the top sub together is adjustable. In one embodiment, the adjustability occurs at an interface between torque sub 24 and top sub 26. This interface is, as illustrated, a position directing and following arrangement 28 wherein the telescopic nature of the connection is torsionally based. In such embodiment, a helical profile 30 such as a screw thread or ball thread etc. on one of the torque sub 24 or top sub 26 is followable by a following feature 32 such as a thread or ball, etc. at the other of the torque sub 24 or top sub 26. Application of torque to top sub 26, then, results in a telescopic difference in overall length of the combined torque sub 24 or top sub 26.

Addressing pressure holding capability is, at an inside dimension of sub 24 and sub 26, an actuatable seal 34 that is responsive to the telescopic length of the torque sub 24/top sub 26 combination. When the overall length of sub 24 and sub 26 is shortened, the seal 34 is actuated to contact, and in some embodiments fully seal with, stub 22. Conversely, when the overall length of subs 24/26 is increased, the seal 34 is radially retracted/axially lengthened such that a light contact or even a clearance condition is achieved relative to the stub. A stop feature 36, which may be a ring as shown, is disposed at the torque sub to prevent over-compression of the seal 34. It should be noted that the axial dimension of the stop feature 36 is specific to the particular diameter of the stub 22 being overshot and must be adjusted accordingly prior to being run in the hole. For example, a stub with a smaller diameter would require an axially shorter stop, all other things being equal; a stub that has a larger diameter requires a shorter stop ring the greater the radial displacement of the seal.

In one embodiment, to improve fluidity of operation and because as illustrated the top sub contacts the seal 34, a thrust bearing 40 is disposed at an uphole end housing 42 of the seal 34. The thrust bearing 40 allows transmission of the compressive force of the torsionally telescopic motion while reducing transmission to seal 34 of the torsional stress of operation of the tool 10. A downhole end housing 44 of seal 34 is fixedly attached to torque sub 24 and no bearing at this location is needed.

A backoff stop 46 is supported in top sub 26 to prevent the top sub 26 from unscrewing from the torque sub 24 during the process of unsetting the seal 34. More specifically, during the unsetting process, when the top sub 26 is torqued to the left to relieve the pressure on the seal, That same left handed torque would cause a separation of the top sub 26 from the torque sub 24. As this is undesirable, the backoff stop 46 is positioned to prevent this occurrence. The backoff stop in one embodiment and as shown is a ball disposed in a groove 48 between the top sub and torque sub. The backoff stop (ball) 46 translates in the groove 48 only so much before causing a binding interference between the torque sub 24, ball 46 and top sub 26. Once the binding interference occurs, unscrewing of the top sub 26 from the torque sub 24 is stopped. And finally, a stop bushing 50 is fixedly connected to top sub 26 to present a no go shoulder 52 whereby the overshot tool 10 will move downhole over the stub 22 only until an uphole end 54 of the stub 22 contacts shoulder 52.

Figure 2:
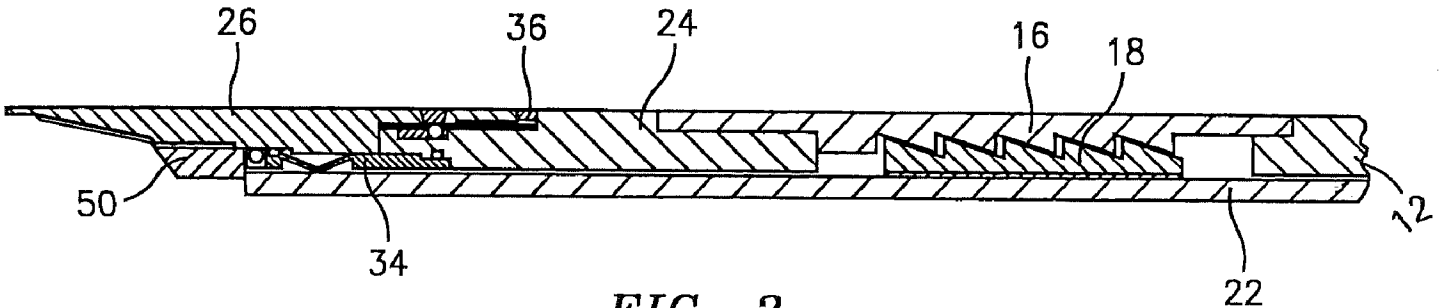
FIG. 2 is a schematic quarter section view of the embodiment illustrated in FIG. 1 in an actuated position.

Each of the components of tool 10 having been identified, reference is now made to FIGS. 1 and 2 simultaneously for a discussion of the operation of the tool.

Initially, it is to be understood that the target stub 22 is ready for retrieval, any dressing or other preconditions or pre-operations having been previously met or undertaken, respectively.

The overshot tool 10 is made up at the surface and run into the hole via appropriate string (not shown). Downhole advance continues until end 54 of stub 22 contacts shoulder 52 of stop bushing 50. At this point, the grapple 14 is actuated in a conventional way (as illustrated, by gravity) to compress contact layer 20 against the target stub 22. This portion of the operation is the one relied upon to pull the stub (etc.) to surface as will be recognized by one of ordinary skill in the art.

Once the grapple 14 is secured to the stub 22, right hand rotation of the top stub 26, which may be effected by rotation of the string from surface, providing the string is rotatable) or by a seal rotation device (whether or not the string is of a rotatable type), causes the overall length of the top sub 26 and torque sub 24 combination to diminish. It is to be appreciated that nothing inherent in the tool itself prevents the tool being configured oppositely to have a left hand rotation, if desired. This action causes a compressive load to be placed upon the seal 34, which then radially displaces into contact with the stub 22. This contact may be a sealing contact. The seal is capable of maintaining a high pressure differential once properly actuated. After completion of the foregoing, the fish (stub 22) can be pulled to surface.

The overshot tool 10 can also be released from the stub if desired by opposite rotation to unactuate the seal 34 and then bumping down on the tool to release the grapple. In the illustrated embodiment the reverse rotation would be left hand rotation as the embodiment of the tool described has right hand threads.

In one embodiment, seal 34 is a metal seal, for example steel configured to have a predisposition to deform in a specific radial direction. To achieve this predisposition, one embodiment of the seal includes a plurality of lines of weakness disposed at the seal wherein at least one of the plurality of lines of weakness is toward an inside surface of the seal and at least one of the plurality of lines of weakness is toward an outside surface of the seal. The direction of deformation will be, when grooves are the lines of weakness, to close the grooves. Where alternate lines of weakness are created, the direction will be the same but material will flow or otherwise be modified in position during the deformation because the space occupied by a specific volume of material will become smaller thereby necessitating a change in position of the material. In one embodiment, the plurality of lines of weakness is three or more lines of weakness. In an embodiment utilizing three lines of weakness, the radial deformation of the seal will be toward the surface having two lines of weakness and away from the surface having one line of weakness. Alternative configurations of the seal include each of those discussed within U.S. Pat. No. 6,896,049, which is incorporated in its entirety herein by reference.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. An overshot tool comprising:

a grapple;

a torque sub rotationally fixed to the grapple;

a metal deformable member in operable communication with the torque sub and responsive to torsional movement thereof; and a threaded telescopic portion in operable communication with the deformable member, to deform and underform the deformable member.

2. The overshot tool as claimed in claim 1 wherein the deformable member is rotationally fixed relative to the grapple.

3. The overshot tool as claimed in claim 1 wherein the deformable member is deformed with right hand rotation of a top sub relative to the grapple.

4. The overshot tool as claimed in claim 1 wherein the deformable member is underformed with left hand rotation of a top sub relative to the grapple.

5. An overshot tool comprising:

a grapple;

a metal deformable seal member in operable communication with the grapple; and a torque sub in operable communication with the grapple and in operable communication with a top sub to deform and underform the seal member.

6. The overshot tool as claimed in claim 5 wherein the top sub threadedly connected to the torque sub.

7. The overshot tool as claimed in claim 5 wherein the metal seal is steel.

8. The overshot tool as claimed in claim 5 wherein the torque sub further includes a thrust bearing.

9. The overshot tool as claimed in claim 5 wherein the torque sub further includes a stop ring.

10. The overshot tool as claimed in claim 5 wherein the torque sub further includes a stop housing.

11. The overshot tool as claimed in claim 5 wherein the tool includes a backoff stop to prevent over extending the tool during underforming of the seal.

12. The overshot tool as claimed in claim 11 wherein the backoff stop is a cooperative projection and recess.

13. The overshot tool as claimed in claim 12 wherein the projection is disposed at one of a top sub and a torque sub of the tool and the recess is disposed at the other of the top sub and the torque sub.

14. The overshot tool as claimed in claim 5 wherein the seal member is predisposed to deform in a radial direction under an axially compressive load.

15. The overshot tool as claimed in claim 5 wherein the seal member includes a plurality of lines of weakness thereat.

16. The overshot tool as claimed in claim 15 wherein the plurality of lines of weakness include at least one line of weakness at an inside dimension of the seal member and at least two lines of weakness at an outside dimension of the seal member.

17. A method for retrieving a fish comprising:

overshooting the fish with an overshot tool including a grapple, a torque sub rotationally fixed to the grapple, a top sub axial length adjustably attached to the torque sub, and a deformable member in operable communication with the torque sub;

actuating the grapple to contact the fish; and adjusting an axial length of the top sub and torque sub to deform the deformable member.

18. The method as claimed in claim 17 wherein the adjusting is by torsionally moving the top sub relative to the grapple thereby telescopically changing an axial length of the tool.

19. The method as claimed in claim 17 further comprising removing the overshot tool from the fish by bumping the tool in a downhole direction and rotating the top sub in a direction opposite a seal making direction.

* * * * *